US010529306B2

(12) United States Patent
Shigenaga et al.

(10) Patent No.: US 10,529,306 B2
(45) Date of Patent: Jan. 7, 2020

(54) PEDAL APPARATUS FOR PERCUSSION INSTRUMENT

(71) Applicant: YAMAHA CORPORATION, Hamamatsu-shi (JP)

(72) Inventors: Fumihiro Shigenaga, Hamamatsu (JP); Hirochika Watanabe, Hamamatsu (JP); Tomohiro Fujita, Hamamatsu (JP); Makoto Seto, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/451,516

(22) Filed: Mar. 7, 2017

(65) Prior Publication Data

US 2017/0278490 A1 Sep. 28, 2017

(30) Foreign Application Priority Data

Mar. 24, 2016 (JP) ..... 2016-060919

(51) Int. Cl.
*G10D 13/00* (2006.01)

(52) U.S. Cl.
CPC ..... *G10D 13/006* (2013.01)

(58) Field of Classification Search
USPC ..... 84/422.1
See application file for complete search history.

(56) References Cited

U.S. PATENT DOCUMENTS 4,134,325 A * 1/1979 Loftus ..... G10D 13/006 84/422.1
5,388,494 A * 2/1995 Hoshino ..... G10D 13/006 84/422.1
5,565,637 A 10/1996 Shigenaga
(Continued)

FOREIGN PATENT DOCUMENTS

EP 1387347 A1 2/2004
JP 2738318 B2 4/1998
(Continued)

OTHER PUBLICATIONS

Office Action issued in Japanese Appln. No. 2016-060919 dated Apr. 9, 2019. English machine translation provided.

*Primary Examiner* — Christopher Uhlir
(74) *Attorney, Agent, or Firm* — Rossi, Kimms & McDowell LLP

(57) ABSTRACT

Pivot shaft support members, formed as component parts separate from support posts of a frame of a pedal apparatus, are mounted on respective upper ends of the support posts, and the pivot shaft support members pivotably support the opposite ends of a pivot shaft for a beater rod. A heel section is provided on a rear end portion of an under plate of the pedal apparatus, and a pair of left and right hinge support members, formed as component parts separate from the heel section, are mounted to the heel section. The hinge support members pivotably support the opposite ends of a pivot shaft of a hinge section of a foot board. Because the pivot shaft support members and the hinge support members are sepa-
(Continued)

rate component parts from the frame, mounted positions of these support members can be adjusted finely during mounting, to the frame, of the support members.

6 Claims, 4 Drawing Sheets

(56) References Cited

U.S. PATENT DOCUMENTS 5,574,237 A * 11/1996 Yanagisawa ..... G10D 13/006 84/422.1
5,646,360 A * 7/1997 Liao ..... G10D 13/006 84/422.1
6,150,596 A * 11/2000 Hsieh ..... G10D 13/006 84/422.1
6,359,205 B1 * 3/2002 Lombardi ..... G10D 13/006 84/422.1
6,504,088 B1 * 1/2003 Hsieh ..... G10D 13/006 84/422.1
6,573,443 B1 * 6/2003 Chen ..... G10D 13/006 84/422.1
6,894,210 B1 5/2005 Lombardi
7,351,901 B2 * 4/2008 Hsieh ..... G10D 13/006 84/422.1
7,449,626 B2 * 11/2008 Chen ..... G10D 13/006 84/422.1
7,629,525 B1 * 12/2009 Lin ..... G10D 13/006 84/422.1
7,777,114 B1 * 8/2010 Chen ..... G10D 13/065 84/422.1
7,868,236 B1 * 1/2011 Lai ..... G10D 13/006 84/422.1
8,269,089 B2 * 9/2012 Sato ..... G10D 13/006 84/422.1
9,236,038 B1 1/2016 Hirasawa
9,460,692 B2 * 10/2016 Chen ..... G10D 13/006
2002/0194979 A1 * 12/2002 Hsieh ..... G10D 13/006 84/421
2008/0173159 A1 * 7/2008 Chen ..... G10D 13/006 84/422.1
2015/0082968 A1 3/2015 Sikra

FOREIGN PATENT DOCUMENTS

JP 2003091276 A 3/2003
JP 2016095379 A 5/2016

* cited by examiner

PEDAL APPARATUS FOR PERCUSSION INSTRUMENT

BACKGROUND

The present invention relates generally to a pedal apparatus for use in a performance of a percussion instrument, such as a bass drum of a drum set, and more particularly to an improvement in a structure for bearing or supporting a pivot shaft.

FIG. 7A is a side view of a conventionally-known pedal apparatus 100 for a percussion instrument, and FIG. 7B is a front view of the pedal apparatus 100 of FIG. 7A taken in a direction of arrow E of FIG. 7A. As shown FIGS. 7A and 7B, a frame 110 of the pedal apparatus 100 includes a pair of left and right support posts 112 provided on and extending upward from an under plate 111, and support sections 113 provided at the respective upper ends of the left and right support posts 112 pivotably bear or support a pivot shaft 102 via not-shown bearings. A rocker member 103 is fixed to the pivot shaft 102, and a rod 105 having a beater 107 at its distal end is mounted to the rocker member 103. A transmission mechanism 104, which comprises for example a chain member, is connected at its one end to the front end of a foot board 106 and connected at the other end to the rocker member 103. The pivot shaft 102 pivots via the transmission mechanism 104 in response to a user depressing the board 106, and the beater 107 strikes a bass drum (not shown) in response to the pivoting of the pivot shaft 102. The construction of such a pedal apparatus is disclosed, for example, in Japanese Patent No. 2738318.

In the frame 110 of the aforementioned conventionally-known pedal apparatus 100, the support posts 112 and the support sections 113 are formed integrally with each other. Thus, with the pivot shaft 102 mounted to the support sections 113, the pivot shaft 102 may rattle or wobble due to distortion, deformation, etc. caused during the integral formation of the support posts 112 and the support sections 113. However, with the conventionally-known, integrally-formed frame 110, where positions, relative to the frame 110, of the support sections 113 supporting the opposite end portions of the pivot shaft 102 and the bearings are fixed, there can be provided no means to adjust a relative mounted position of the pivot shaft 102 to the frame 110 (support sections 113), and thus, it is not possible to correct the unwanted wobbling of the pivot shaft 102.

Further, in the case where the support posts 112 and the support sections 113 are formed integrally with each other as noted above, the respective shaft bearing axes of the left and right support sections 113 may be undesirably displaced with each other with respect to the axis of the pivot shaft 102 or may even curve or bend due to the distortion, deformation, etc. caused during the integral formation. Because the left and right support sections 113 are considerably spaced from each other, it is difficult to correct the displacement of the shaft bearing axes of the left and right support sections 113 by post-processing following the formation of the frame 110.

Furthermore, the foot board 106 is pivotably mounted at the rear end to a heel section 114 via a hinge section 108. Left and right support sections 115 supporting a pivot shaft 108*a* of the hinge section 108 are integrally formed with the heel section 114. Thus, with the structure for supporting the hinge section 108 at the rear end of the foot board 106 too, there would be encountered the problems that: a relative mounted position of the hinge section 108 to the heel section 114 cannot be adjusted; the respective shaft bearing axes of the left and right support sections 115 may be undesirably disaligned or displaced with each other with respect to the axis of the pivot shaft 108*a*; and it is difficult to correct the displacement of the shaft bearing axes of the left and right support sections 115 by post-processing.

Further, U.S. Pat. Nos. 6,894,210 and 9,236,038 corresponding to Japanese patent application laid-open No. 2016-095379 also disclose prior art of a pedal apparatus for a percussion instrument.

SUMMARY OF THE INVENTION

In view of the foregoing prior art problems, it is an object of the present invention to provide an improved pedal apparatus for a percussion instrument which allows one or more pivot shafts, provided in the pedal apparatus, to be appropriately assembled to a frame with a high accuracy.

In order to accomplish the above-mentioned object, the present invention provides an improved pedal apparatus for a percussion instrument, which comprises: a frame; a foot board; a rod pivotable to move a beater; a pivot shaft provided in a motion link mechanism that pivots the rod in response to pivoting of the foot board; a support member formed as a component part separate from the frame and constructed to pivotably support the pivot shaft; and a connection section provided in corresponding relation to the support member and constructed to connect the corresponding support member to the frame.

In the pedal apparatus for a percussion instrument according to the present invention, the support member that pivotably supports the pivot shaft is formed as a separate component part from the frame, and this support member is connected to the frame via the connection section. Because the support member is a separate component part from the frame, a mounted position of the support member relative to the frame can be adjusted at the time of mounting, to the frame, of the support member. By such mounted position adjustment, it is possible to, for example, duly position the respective shaft bearing axes of a pair of left and right support members in alignment with each other with respect the axis of the pivot shaft. Thus, the pivot shaft can be appropriately assembled to the frame with a high accuracy as compared to the conventionally-known technique where the frame and the support members are formed integrally with each other.

In a case where a plurality of pivot shafts are provided in the motion link mechanism that pivots the rod in response to pivoting of the foot board, a combined structure the support member and the corresponding connection section may be applied in relation to at least one of the pivot shafts. Alternatively, such a combined structure the support member and the corresponding connection section may be applied individually to each of the pivot shafts in accordance with the basic principles of the present invention.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION

Now, with reference to the accompanying drawings, a detailed description will be given about an embodiment of a pedal apparatus for a percussion instrument of the present invention. The pedal apparatus for a percussion instrument (hereinafter also referred to simply as "pedal apparatus") is used, for example, in a performance of a percussion instrument, such as a bass drum of a drum set.

Figure 1:
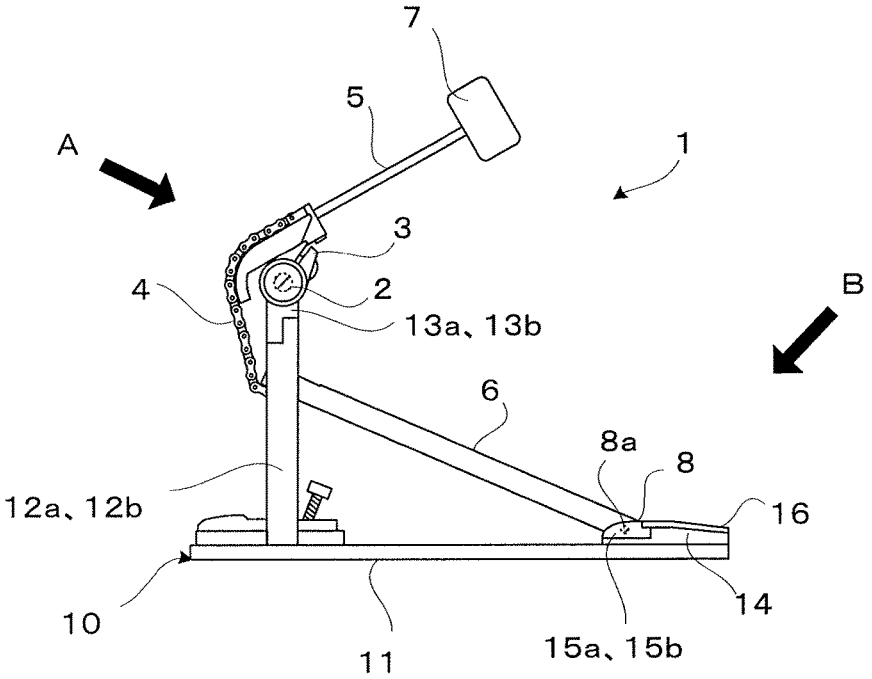
FIG. 1 is a side view showing an example construction of a pedal apparatus for a percussion instrument in accordance with an embodiment of the present invention.
Figure 2:
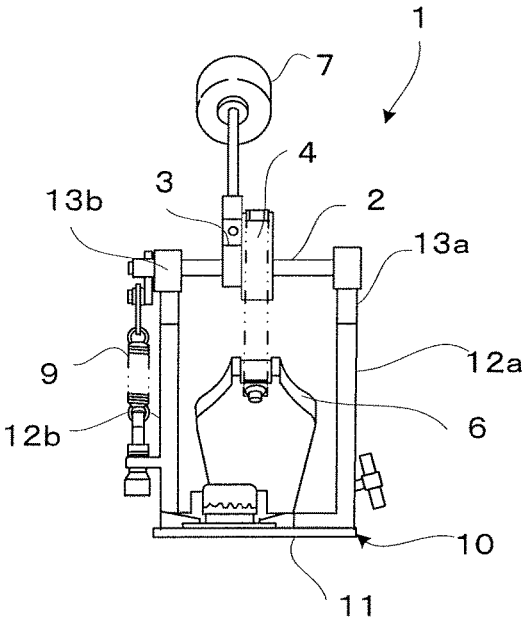
FIG. 2 is a front view of the pedal apparatus of FIG. 1.

FIG. 1 is a side view showing an example construction of the pedal apparatus 1, and FIG. 2 is a front view of the pedal apparatus 1 taken in a direction of arrow A of FIG. 1. In the following description, terms "forward". "rearward", "front", "rear", "upward", "downward", "up", "down", etc. are used to refer to directions as viewed when the pedal apparatus 1 is placed on a horizontal floor surface as shown in FIG. 1; for example, "leftward" in FIG. 1 corresponds to a "forward" direction of the pedal apparatus 1, and "upward" in FIG. 1 corresponds to an "upward" direction of the pedal apparatus 1.

As shown in FIGS. 1 and 2, the pedal apparatus 1 includes a frame 10 installed on the floor surface. The frame 10 includes an under plate 11, and a pair of left and right support posts 12*a* and 12*b* provided on and projecting upward from front end portions of the under plate 10. Pivot shaft support members 13*a* and 13*b* that are formed as component parts separate from the support posts 12*a* and 12*b* and that pivotably support the opposite ends of a pivot shaft 2 are mounted to the respective upper ends of the support posts 12*a* and 12*b*. With the pivot shaft support members 13*a* and 13*b* mounted to the upper ends of the support posts 12*a* and 12*b* like this, the pivot shaft 2 is pivotably mounted to the support posts 12*a* and 12*b*. Namely, in this case, the support posts 12*a* and 12*b* are provided in corresponding relation to the pivot shaft support members 13*a* and 13*b* and function as connection sections constructed to connect the corresponding support members 13*a* and 13*b* to the frame 10.

A rocker member 3 is fixed to a substantial axial middle portion of the pivot shaft 2, and a beater 7 is mounted to the distal end of a rod 5 that is in turn mounted to the rocker member 3. The rocker member 3, the rod 5 and the beater 7 together constitute a striking mechanism of the pedal apparatus 1. A transmission mechanism 4 that comprises for example a chain member is connected at it upper end to the rocker member 3, and a foot board 6 is connected to the lower end of the transmission mechanism 4.

Figure 3:
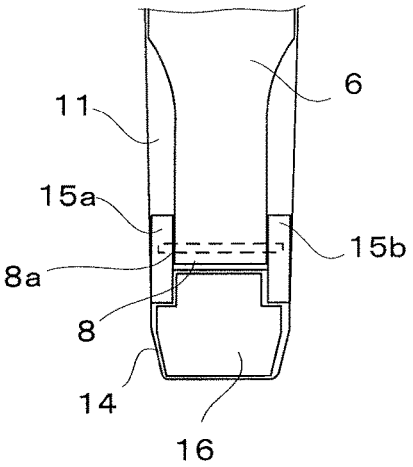
FIG. 3 is a top plan view showing a rear end section the pedal apparatus.

FIG. 3 is a fragmentary top plan view showing a rear end section of the pedal apparatus 1 with illustration of a front end section of the pedal apparatus 1 omitted. As shown in FIGS. 1 and 3, the foot board 6 includes a hinge section 8 provided at its rear end. A heel section 14 is provided on a rear end portion of the under plate 11. To the heel section 14 are mounted a pair of left and right hinge support members 15*a* and 15*b* that are formed as component parts separate from the heel section 14 and that support the opposite ends of a pivot shaft 8*a* of the hinge section 8. With the hinge support members 15*a* and 15*b* mounted to the heel section 14, the pivot shaft 8*a* of the hinge section 8 is pivotably mounted to the heel section 14 of the frame 10. The upper surface of the heel section 14 is covered with a cover member 16 formed, for example, of rubber. Namely, in this case, the heel section 14 is provided in corresponding relation to the hinge support members 15*a* and 15*b* and functions as a connection section constructed to connect the hinge support members 15*a* and 15*b* to the frame 10.

As the user depresses the foot board 6, the foot board 6 pivots about the hinge section 8 downward from the position shown in FIG. 1. In response to such pivoting of the foot board 6, the transmission mechanism 4 moves downward, in response to which the pivot shaft 2 pivots forward about the pivot shaft support members 13*a* and 13*b*. Namely, rotational force produced by the user's depression of the foot board 6 is transmitted via the transmission mechanism 4 to the pivot shaft 2, and then, in response to the pivoting of the pivot shaft 2, the beater 7 angularly moves to strike the drumhead (not shown) of the bass drum. Then, as the user releases the foot board 2 from the depressed state, the foot board 6 returns to the position shown in FIG. 1 by upward biasing force of a return spring 9 (FIG. 2) connected to one end of the pivot shaft 2. In the pedal apparatus constructed in the aforementioned manner, a mechanism including the pivot shaft 8*a* of the hinge section 8, the transmission mechanism 4, the rocker member 3, the rod 5, the pivot shaft 2, etc. functions as a motion link mechanism for pivoting the rod 5 in response to the pivoting of the foot board 6.

Figure 4A:
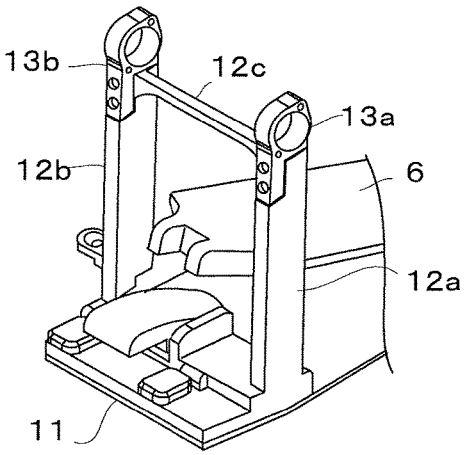
FIG. 4A is a perspective view of the pedal apparatus taken in a direction of arrow A of FIG. 1, which particularly shows the pedal apparatus with a transmission mechanism etc. removed for clarity.
Figure 4B:
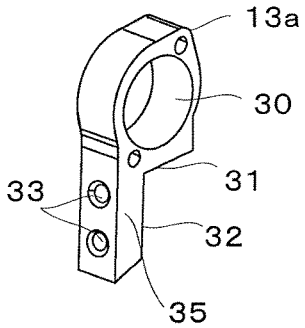
FIG. 4B is a fragmentary perspective view showing one of pivot shaft support members in enlarged scale.

Next, with reference to FIGS. 4A to 4D, a description will be given about an example detailed construction of the pivot shaft support members 13*a* and 13*b*. FIG. 4A is a perspective view of the pedal apparatus 1 taken in a direction of arrow A of FIG. 1, which particularly shows the pedal apparatus 1 with the pivot shaft 2, the transmission mechanism 4, etc. removed and with illustration of the rear end section of the pedal apparatus 1 omitted for clarity. FIG. 4B is a fragmentary perspective view showing one of the pivot shaft support members 13*a* in enlarged scale, and FIG. 4C is a perspective view showing a state where the pivot shaft support members 13*a* and 13*b* are removed from the pedal apparatus 1 shown in FIG. 4A.

As shown in FIG. 4B, the pivot shaft support member 13*a* has a through-hole 30 formed for insertion therein (or therethrough) of an end portion of the pivot shaft 2. A bearing 34*a* is incorporated in the through-hole 30 as shown in FIG. 4D. The pivot shaft support member 13*a* also has, on its lower region, two, i.e. first and second, mounting surfaces 31 and 32 as a mounting section to be mounted to the support post 12*a*. The first mounting surface 31 is formed to extend substantially parallel to the upper surface of the support post 12*a*, or in other words, substantially perpendicularly to the length of the support post 12*a*. The second mounting surface 32 is formed to extend substantially perpendicularly to the first mounting surface 31; more specifically, the second mounting surface 32 is one side surface of a leg portion 35 formed to extend downward from the first mounting surface 31. Screw holes 33 are formed in another side surface of the leg portion 35 (i.e., the surface of the leg portion 35 opposite from the second mounting surface 32) for passage therethrough of screws for fixing the pivot shaft support member 13*a* to the support post 12*a*.

The other pivot shaft support member 13*b* has a through-hole 30 having a bearing 34*b* (see FIG. 4D), two, or, first and second mounting surfaces 31 and 32 as a mounting section to be mounted to the support post 12*b* and a screw hole 33 which are similar to those of the pivot shaft support member 13*a* shown in FIG. 4B, although not particularly depicted with reference numerals in FIGS. 4A to 4D.

Figure 4C:
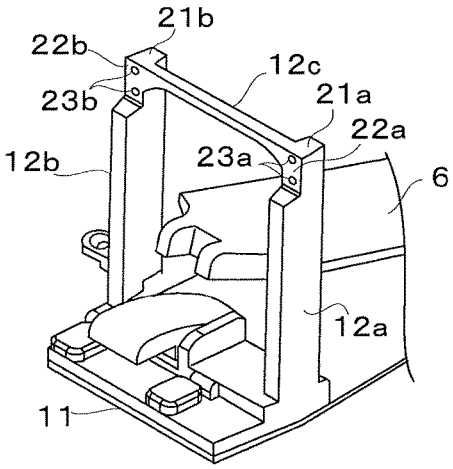
FIG. 4C is a perspective view showing a frame (support posts) with the pivot shaft support members removed therefrom for clarity.
Figure 4D:
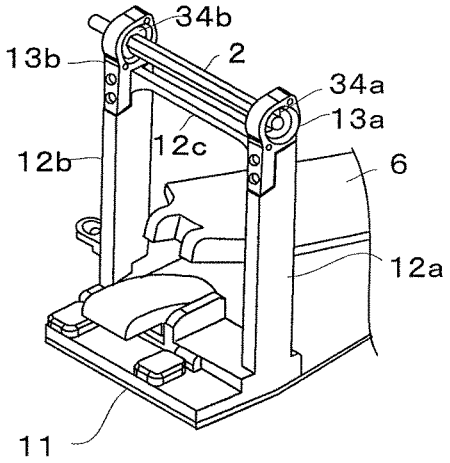
FIG. 4D shows a state where a pivot shaft is assembled or mounted to the support posts shown in FIG. 4A.

As shown in FIG. 4C, each of the support posts 12*a* or 12*b* has a first abutting surface 21*a* or 21*b* formed at its upper end to abut against the first mounting surface 31 of the corresponding pivot shaft support member 13*a* or 13*b*, and a second abutting surface 22*a* or 22*b* extending downward from the first abutting surface 21*a* to abut against the second mounting surface 32 of the corresponding pivot shaft support member 13*a* or 13*b*. Each of the second abutting surfaces 22*a* and 22*b* has screw holes 23*a* and 23*b* corresponding to the screw holes 33 of the corresponding pivot shaft support member 13*a* or 13*b*. A subframe 12*c* is formed integrally with the support posts 12*a* and 12*b* and extends between the upper ends of the support posts 12*a* and 12*b*. With such a subframe 12*c* provided between the support posts 12*a* and 12*b* in parallel to the pivot shaft 2, the frame 10 can have an enhanced structural stability.

The left and right support posts 12*a* and 12*b* are formed in such a manner that flatness of the first abutting surfaces 21*a* and 21*b* and flatness of the second abutting surfaces 22*a* and 22*b* can be made equal between the left and right support posts 12*a* and 12*b* through post-processing. Because such processing for making the flatness equal between the left and right support posts 12*a* and 12*b* is performed on the flat surfaces, it can be performed with a high accuracy and precision. In this way, it is possible to duly position the respective shaft bearing axes of the left and right support members 13*a* and 13*b* in alignment with each other with respect the axis of the pivot shaft 2. Thus, the pivot shaft 2 can be appropriately assembled to the frame 10 with a high accuracy.

The following describe an example operational sequence for mounting the pivot shaft support members 13*a* and 13*b* to the corresponding support posts 12*a* and 12*b*. First, the pivot shaft support members 13*a* and 13*b* are mounted to the opposite ends of the pivot shaft 2 via the bearings 34*a* and 34*b*, and then, the two mounting surfaces 31 and 32 of the pivot shaft support members 13*a* and 13*b* are abutted against the abutting surfaces 21*a* and 22*a* and 22*a* and 22*b*, respectively, of the support posts 12*a* and 12*b*. Then, the pivot shaft support members 13*a* and 13*b* are fastened or fixed to the corresponding support posts 12*a* and 12*b* by the screws passed through the screw holes 33 into the screw holes 23*a* and 23*b*. FIG. 4D shows a state where the pivot shaft 2 is assembled or mounted to the support posts 12*a* and 12*b* shown in FIG. 4A. Note that any other suitable mounting operational sequence than the aforementioned may be employed for mounting the pivot shaft support members 13*a* and 13*b* to the support posts 12*a* and 12*b*.

Because the pivot shaft support members 13*a* and 13*b* are constructed in such a manner that the two mounting surfaces 31 and 32 abut against the support posts 12*a* and 12*b* as the pivot shaft support members 13*a* and 13*b* are mounted to the support posts 12*a* and 12*b*, they can be duly positioned at predetermined positions defined by the two mounting surfaces 31 and 32. Namely, in the instant embodiment, a positioning mechanism for each of the pivot shaft support members 13*a* and 13*b* comprises a mounting section constructed in such a manner that the pivot shaft support member 13*a* or 13*b* abuts at two or more surfaces (31 and 32) against the corresponding support post 12*a* or 12*b*.

Further, when the pivot shaft support members 13*a* and 13*b* are to be mounted to the support posts 12*a* and 12*b*, mounted positions of the pivot shaft support members 13*a* and 13*b* relative to the support posts 12*a* and 12*b* can be adjusted finely by adjusting the respective screwed-in amounts of the screws in the screw holes 33, 23*a* and 23*b*, fixing the pivot shaft support members 13*a* and 13*b* by pressing them laterally from the left and right sides, or the like. By such mounted position adjustment of the pivot shaft support members 13*a* and 13*b*, it is possible to prevent unwanted wobbling of the pivot shaft 2 assembled to the frame 10.

Figure 5:
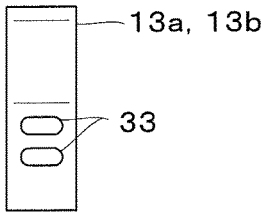
FIG. 5 is a front view showing a modified embodiment of the pivot shaft support member where screw holes are each a laterally elongated hole.

FIG. 5 shows a modified embodiment where the screw holes 33 in each of the pivot shaft support members 13*a* and 13*b* are each a laterally elongated hole that is elongated in shape in the left-right direction. In this case, the screw holes 33 function as a mounted position adjustment mechanism for adjusting the mounted positions of the pivot shaft support members 13*a* and 13*b* relative to the support posts 12*a* and 12*b*. With such a mounted position adjustment mechanism, the user can adjust the mounted positions of the pivot shaft support members 13*a* and 13*b* in the left-right direction relative to the support posts 12*a* and 12*b* within a range permitted by the screw holes 33. Note that the screw holes 33 may be formed in any other shape, such as a shape elongated vertically or in the up-down direction, or a shape that permits positional adjustment of the pivot shaft support members 13*a* and 13*b* in both the left-right direction and the up-down direction.

According to the above-described embodiments of the pedal apparatus 1, where the pivot shaft support members 13*a* and 13*b* are formed as component parts separate from the support posts 12*a* and 12*b*, the pivot shaft 2 can be appropriately assembled to the support posts 12*a* and 12*b* of the frame 10 with a high accuracy. In the above-described embodiments, the basic principles of the present invention are applied in relation to the pivot shaft 2 of the rod 5 provided for pivoting the beater 7, and the pivot shaft 2 is a pivot shaft (first pivot shaft) provided in the motion link mechanism for pivoting the rod 5 in response to pivoting motion of the foot board 6. Further, the pivot shaft support members 13*a* and 13*b* constitute a support member (first support member) that pivotably supports the first pivot shaft 2, and the support posts 12*a* and 12*b* constitute a connection section (first connection section) that is constructed to connect the first support member to the frame 10.

Figure 6A:
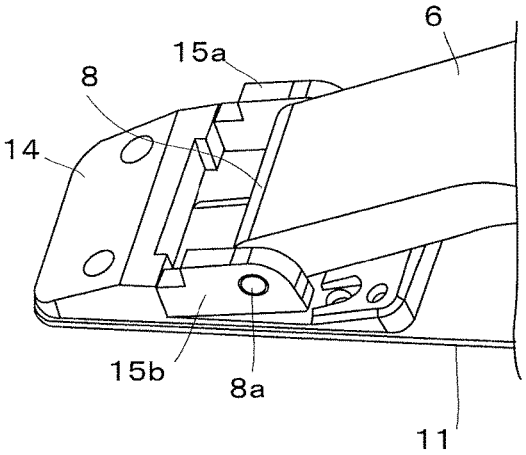
FIG. 6A is a perspective view showing a rear end section of the pedal apparatus taken in a direction of arrow B of FIG. 1 with the transmission mechanism etc. removed for clarity.

Next, with reference to FIG. 6, a description will be given about an example where the basic principles of the present invention are applied in relation to the pivot shaft 8*a* for the foot board 6. FIG. 6A is a perspective view showing the rear end section of the pedal apparatus 1 in a direction of arrow B of FIG. 1 with the cover member 16 removed and with illustration of a front end section of the apparatus 1 omitted for clarity. As shown in FIG. 6A, the left and right hinge support members 15*a* and 15*b* are disposed on left and right side edge portions of the heel section 14.

Figure 6B:
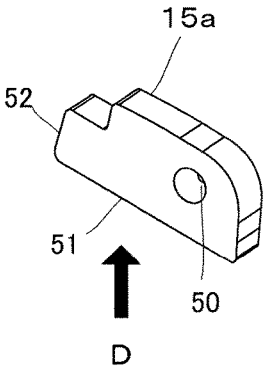
FIG. 6B is a fragmentary perspective view showing in an enlarged scale one of hinge support members.
Figure 6C:
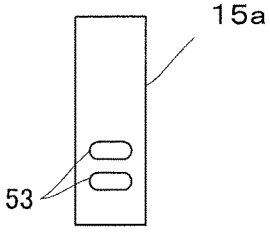
FIG. 6C is a bottom end view of the hinge support member.

FIG. 6B is a perspective view showing in an enlarged scale one of the left and right hinge support members 15*a*. The hinge support member 15*a* has a through-hole 50 formed therein to support the pivot shaft 8*a* of (for) the foot board 6, and a not-shown bearing is incorporated in the through-hole 50. The hinge support member 15*a* has two, i.e. first and second, mounting surfaces 51 and 52 as a mounting section to be mounted to the heel section 14. The first mounting surface 51 corresponds to the bottom surface of the hinge support member 15*a*, and the second mounting surface 52 corresponds to a rear end surface of the hinge support member 15*a*. The first and second hinge mounting surfaces 51 and 52 are formed at right angles to each other. FIG. 6C is a bottom end view of the hinge support member 15*a*. The hinge support member 15*a* has screw holes 53 formed for insertion therein of screws for fastening the hinge support member 15*a* to the heel section 14. The screw holes 53 are each a laterally elongated hole, elongated in the left-right direction, so that a mounted position of the hinge support member 15*a* relative to the heel section 14 is adjustable in the left-right section within a range permitted by the screw holes 53.

Although not particularly shown, the other hinge support member 15*b* has a through-hole 50, two mounting surfaces 51 and 52 and a screw hole 53 which are similar to those of the one hinge support member 15*a* shown in FIG. 6B, although not particularly depicted with reference numerals.

Figure 6D:
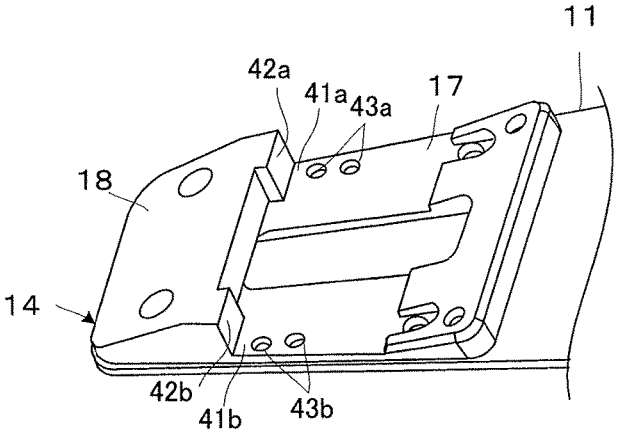
FIG. 6D is a perspective view showing a heel section of the pedal apparatus with the hinge support members removed for clarity.
Figure 7A:
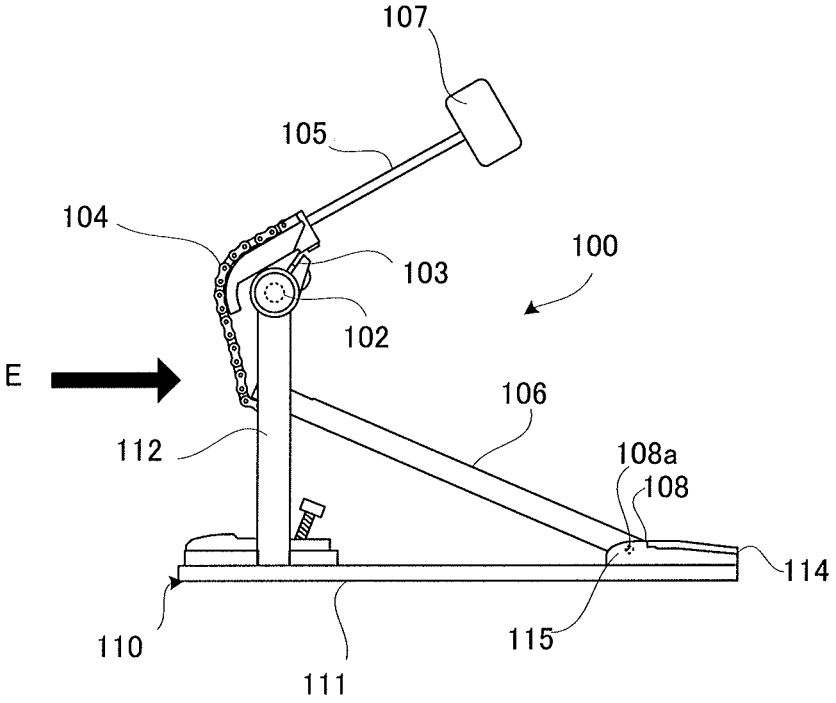
(PRIOR ART) F I G. 7 A
FIG. 7A is a side view of a conventionally-known pedal apparatus for a percussion instrument.
Figure 7B:
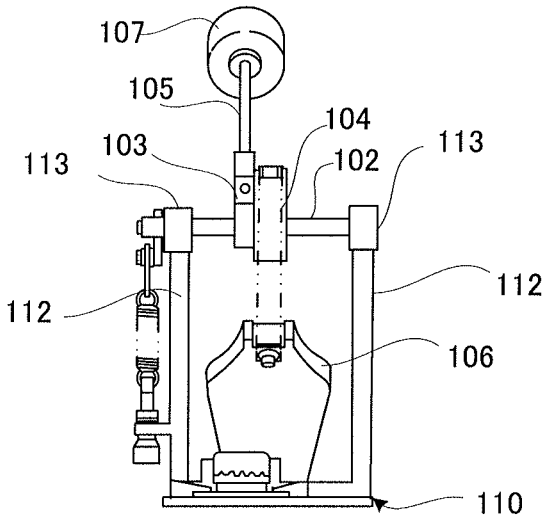
(PRIOR ART) F I G. 7 B
FIG. 7B is a front view of the pedal apparatus taken in a direction of arrow E of FIG. 7A.

FIG. 6D shows the rear end section of the pedal apparatus 1 with the hinge support members 15*a* and 15*b* removed for clarity. As shown in FIG. 6D, the heel section 14 includes a base portion 17, and a heel body 18 formed integrally with the base portion 17 and projecting upward from the base portion 17. The base portion 17 has, on its left and right side edge portions, first abutting surfaces 41*a* and 41*b* that abut against the first mounting surfaces 51 of the left and right hinge support members 15*a* and 15*b*. The heel body 18 has, on its left and right front end surfaces, second abutting surfaces 42*a* and 42*b* that abut against the second mounting surfaces 52 of the left and right hinge support members 15*a* and 15*b*. The first abutting surfaces 41*a* and 41*b* each have screw holes 43*a* and 43*b* corresponding to the screw holes 53 of the corresponding hinge support member 15*a* or 15*b*.

The heel section 14 too is formed in such a manner that flatness of the first abutting surfaces 41*a* and 41*b* and flatness of the second abutting surfaces 42*a* and 42*b* can be made equal through post-processing. In this way, the respective shaft bearing axes of the left and right hinge support member 15*a* and 15*b* mounted to the heel section 14 can be duly positioned in alignment with each other with respect to the axis of the pivot shaft 8*a* of the hinge section 8, so that the pivot shaft 8*a* of the hinge section 8 can be appropriately supported by the left and right hinge support members 15*a* and 15*b*.

The following describe an example operational sequence for mounting the hinge support members 15*a* and 15*b* to the heel section 14. First, the hinge support members 15*a* and 15*b* are mounted to the opposite ends of the pivot shaft 8*a* of the hinge section 8, and then, the two mounting surfaces 51 and 52 of the hinge support members 15*a* and 15*b* are abutted against the abutting surfaces 41*a*, 42*a* and 41*b*, 42*b*, respectively, of the heel section 14. Then, the hinge support members 15*a* and 15*b* are fastened or fixed to the heel section 14 by means of screws passed through the screw holes 43*a* and 43*b* into the screw holes 53. Note that any other suitable hinge-support-member mounting operational sequence than the aforementioned may be employed.

With the above-described construction where the two mounting surfaces 51 and 52 of each of the hinge support members 15*a* and 15*b* abut against the abutting surfaces 41*a*, 42*a* and 41*b*, 42*b*, respectively, of the heel section 14 during mounting, to the heel section 14, of the hinge support members 15*a* and 15*b*, the hinge support members 15*a* and 15*b* can be duly positioned at predetermined positions defined by the two mounting surfaces 51 and 52. Namely, in the instant embodiment, each of the hinge support members 15*a* and 15*b* has, as a positioning mechanism, a mounting section formed in such a manner that the hinge support member abuts against the heel section 14 at two or more surfaces (51 and 52).

Further, when the hinge support members 15*a* and 15*b* are to be mounted to the heel section 14, mounted positions of the hinge support members 15*a* and 15*b* relative to the heel section 14 can be adjusted finely by adjusting screwed-in amounts of the screws in the screw holes 53, 43*a* and 43*b*, fixing the hinge support members 15*a* and 15*b* by pressing them laterally from the left and right sides, or the like. By such fine mounted position adjustment of the hinge support members 15*a* and 15*b*, it is possible to prevent unwanted wobbling of the pivot shaft 8*a* of the hinge section 8 assembled to the heel section 14.

Furthermore, the screw holes 53 formed as laterally elongated holes in the hinge support members 15*a* and 15*b* function as a mounted position adjustment mechanism for the support members 15*a* and 15*b*. With such a mounted position adjustment mechanism, the user can adjust the mounted positions of the hinge support members 15*a* and 15*b* in the left-right direction within a range permitted by the screw holes 53. Note that the screw holes 53 may be formed in any other shape than the aforementioned, such as a shape elongated in the front-rear direction, or a shape that permits positional adjustment of the hinge support members 15*a* and 15*b* in both the left-right direction and the front-rear direction.

In the instant embodiment of the pedal apparatus 1, where the hinge support members 15*a* and 15*b* are formed as component parts separate from the heel section 14 as noted above, the pivot shaft 8*a* of the hinge section 8 can be appropriately assembled to the heel section 14 with a high accuracy. In the above-described embodiment, the basic principles of the present invention are applied in relation to the pivot shaft 8*a* of the foot board 6, and the pivot shaft 8*a* is a pivot shaft (second pivot shaft) provided in the aforementioned motion link mechanism for pivoting the rod 5 in response to a pivoting motion of the foot board 6. Further, the hinge support members 15*a* and 15*b* constitute a support member (second support member) that pivotably supports the second pivot shaft 8*a*, and a connection structure (abutting surfaces) of the heel section 14 for connecting the hinge support members 15*a* and 15*b* to the heel section 14 constitutes a connection section (second connection section) that is constructed to connect the second support member to the frame 10 via the heel section 14 of the foot board 6.

It should be appreciated that the present invention is not limited to the above-described embodiments and may be modified variously within the scope of the technical idea disclosed in the claims, specification and drawings.

For example, as another example of the mounted position adjustment mechanism provided in each of the pivot shaft support members 13*a* and 13*b*, a position adjustment member may be provided between each of the pivot shaft support members 13*a* and 13*b* and the corresponding support post

12*a* or 12*b*. Each of such position adjustment members may be a resilient member, such as a plain washer or a spring washer. The positions, in the up-down direction, of the pivot shaft support members 13*a* and 13*b* can be adjusted via the position adjustment members provided between the first mounting surfaces 31 and the first abutting surfaces 21*a* and 21*b*, and the positions, in the front-rear direction, of the pivot shaft support members 13*a* and 13*b* can be adjusted via the position adjustment members provided between the second mounting surfaces 32 and the second abutting surfaces 22*a* and 22*b*. Further, as another example of the mounted position adjustment mechanism provided in each of the hinge support members 15*a* and 15*b*, position adjustment members similar to the aforementioned position adjustment members of the pivot shaft support members 13*a* and 13 may be provided between the hinge support members 15*a* and 15*b* and the heel section 14.

Furthermore, the positioning mechanism of each of the pivot shaft support members 13*a* and 13*b* is not limited to the aforementioned construction where each of the pivot shaft support members 13*a* and 13*b* abuts against the support post 12*a* or 12*b* at two or more mounting surfaces 31 and 32, and it may be of any other suitable construction. For example, positioning guide holes or grooves may be provided the pivot shaft support members 13*a* and 13*b* or in the support posts 12*a* and 12*b*. The positioning mechanism of each of the hinge support members 15*a* and 15*b* too is not limited to the construction where each of the hinge support members 15*a* and 15*b* abuts against the heel section 14 at two or more mounting surfaces 51 and 52, and it may be of any other suitable construction. For example, positioning guide holes or grooves may be provided in the hinge support members 15*a* and 15*b* or in the heel section 14. Whereas, in the above-described embodiments, combined structures the support members 13*a*, 13*b* and 15*a*, 15*b* (first and second support members) and the corresponding support posts 12*a*, 12*b* and hinge support members 15*a* and 15*b* (first and second connection sections) are provided in relation to both the pivot shaft 2 of the rod 5 (i.e., the first pivot shaft) and the pivot shaft 8*a* of the foot board 6 (i.e., the second pivot shaft) in accordance with the basic principles of the present invention, the present invention is not so limited, and the combined structure of the support member and the connection section according to the present invention may be provided in relation to only one of the pivot shafts 2 and 8*a* (i.e., the first pivot shaft or the second pivot shaft).

This application is based on, and claims priority to, JP PA 2016-060919 filed on 24 Mar. 2016. The disclosure of the priority application, in its entirety, including the drawings, claims, and the specification thereof, are incorporated herein by reference.

What is claimed is:

1. A pedal apparatus for a percussion instrument, the pedal apparatus comprising:

a frame including first and second support posts, and a subframe disposed integrally with and extending between the first and second support posts;

a foot board pivotally mounted to the frame;

a motion link mechanism configured to move a beater in response to pivoting of the foot board; and a support member separate from the frame and configured to pivotably support a pivot shaft that pivots in response to pivoting of the foot board, wherein the subframe is parallel to the pivot shaft and extends from upper ends of the first and second support posts, wherein the support member comprises first and second pivot shaft support members:

each configured to pivotably support the pivot shaft with the pivot shaft extending between the first and second pivot shaft support members;

removably connected to the first or second support post respectively; and each include at least first and second mounting surfaces, wherein each of the first and second support posts includes at least first and second counterpart mounting surfaces respectively abutting the at least first and second mounting surfaces of the first or second pivot shaft support member respectively; and a first positioning mechanism comprising:

the first and second mounting surfaces of the first pivot shaft support member and the first and second counterpart mounting surfaces of the first support post; and at least one hole extending through the first pivot shaft support member for receiving a fastener that secures the first pivot shaft support member to the respective first support post, each of the at least one hole extending perpendicular to the pivot shaft in a condition where the pivot shaft is installed; and a second positioning mechanism comprising:

the first and second mounting surfaces of the second pivot shaft support member and the first and second counterpart mounting surfaces of the second support post; and at least one additional hole extending through the second pivot shaft support member for receiving a fastener that secures the second pivot shaft support member to the respective second support post, each of the at least one additional hole extending perpendicular to the pivot shaft in a condition where the pivot shaft is installed.

2. The pedal apparatus for a percussion instrument as claimed in claim 1, wherein:

the first positioning mechanism adjusts a mounted position of the first pivot shaft support member relative to the first support post, and the second positioning mechanism adjusts a mounted position of the second pivot shaft support member relative to the second support post.

3. The pedal apparatus for a percussion instrument as claimed in claim 2, wherein each of the first and second positioning mechanisms includes a position adjustment member disposed between the respective first or second pivot shaft support member and the respective first or second support post.

4. The pedal apparatus for a percussion instrument as claimed in claim 1, wherein the motion link mechanism includes:

the pivot shaft that pivots in response to pivoting of the foot board; and a rod mounted to the pivot shaft so that the rod is pivotable along with the pivot shaft to move the beater, which is disposed at one end of the rod.

5. The pedal apparatus for a percussion instrument as claimed in claim 1, wherein:

the first and second mounting surfaces of each of the first and second pivot shaft support members extend substantially perpendicular to each other, the first and second counterpart mounting surfaces of each of the first and second support posts extend substantially perpendicular to each other, the first mounting surface of each of the first and second pivot shaft support members is positioned above the first counterpart mounting surface of the respective first or second support post, each of the first counterpart mounting surfaces of the first and second support post being a top surface of the respective first or second support post, and the second mounting surface of each of the first and second pivot shaft support members extends below the top surface of the respective first or second support post.

6. The pedal apparatus for a percussion instrument as claimed in claim 1, wherein:

the first mounting surface, of each of the first and second pivot shaft support members positioned above the top surface of the respective first or second support post, is substantially parallel to the top surface thereof and is substantially perpendicular to a length of the respective first or second support post, and the second mounting surface, of each of the first and second pivot shaft support members extending below the top surface of the respective first or second support post, is disposed on one side surface of the respective first or second support post.

* * * * *